US009200503B2

(12) United States Patent
Irani et al.

(10) Patent No.: US 9,200,503 B2
(45) Date of Patent: Dec. 1, 2015

(54) SYSTEMS AND METHODS FOR CLEANING A WELL FACE DURING FORMATION TESTING OPERATIONS

(75) Inventors: Cyrus A. Irani, Houston, TX (US); Clive D. Menezes, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/389,487

(22) PCT Filed: May 8, 2012

(86) PCT No.: PCT/US2012/036866

§ 371 (c)(1), (2), (4) Date: Sep. 30, 2014

(87) PCT Pub. No.: WO2013/169230

PCT Pub. Date: Nov. 14, 2013

(65) Prior Publication Data

US 2015/0053399 A1 Feb. 26, 2015

(51) Int. Cl.

| | |
|---|---|
| ***E21B 49/10*** | (2006.01) |
| ***E21B 37/00*** | (2006.01) |
| ***E21B 37/02*** | (2006.01) |
| ***E21B 49/08*** | (2006.01) |

(52) U.S. Cl.

CPC ..... *E21B 37/00* (2013.01); *E21B 37/02* (2013.01); *E21B 49/081* (2013.01); *E21B 49/10* (2013.01)

(58) Field of Classification Search

CPC ..... E21B 49/10; E21B 37/06; E21B 37/08

See application file for complete search history.

(56) References Cited

U.S. PATENT DOCUMENTS

| | | | | |
|---|---|---|---|---|
| 2008/0066535 | A1 | 3/2008 | Vasques et al. | |
| 2010/0126717 | A1 * | 5/2010 | Kuchuk et al. | 166/250.03 |
| 2010/0132940 | A1 | 6/2010 | Proett et al. | |
| 2010/0206551 | A1 * | 8/2010 | Knobloch et al. | 166/227 |

FOREIGN PATENT DOCUMENTS

| | | |
|---|---|---|
| GB | 2418938 A | 4/2006 |
| GB | 2443038 A | 4/2008 |

OTHER PUBLICATIONS

International Search Report issued in related PCT Application No. PCT/US2012/036866 mailed Jan. 15, 2013, 3 pages.

International Preliminary Report on Patentability issued in related PCT Application No. PCT/US2012/036866 mailed May 22, 2014, 26 pages.

* cited by examiner

*Primary Examiner* — David Andrews

(74) *Attorney, Agent, or Firm* — Alan Bryson; Baker Botts L.L.P.

(57) ABSTRACT

A method of cleaning a well face during formation testing at a drill site is disclosed. A collection chamber disposed in a formation tester tool may be at least partially filled with cleansing fluid. The formation tester tool may be introduced into a wellbore and the cleansing fluid may be ejected through a probe coupled to the formation tester tool. The collection chamber may then be at least partially filled with a formation fluid sample. A face of the probe may be contacted by a retractable cleaning mechanism coupled to the formation tester tool.

17 Claims, 5 Drawing Sheets

SYSTEMS AND METHODS FOR CLEANING A WELL FACE DURING FORMATION TESTING OPERATIONS

CROSS-REFERENCE TO RELATED APPLICATION

This application is a U.S. National Stage Application of International Application No. PCT/US2012/036866 filed May 8, 2012, which is hereby incorporated by reference in its entirety.

BACKGROUND

The present disclosure generally relates to testing and evaluation of subterranean formations and formation fluids and, more particularly, to systems and methods for cleaning a well face during formation testing operations.

It is well known in the subterranean well drilling and completion art to perform tests on formations penetrated by a wellbore. Such tests are typically performed in order to determine geological or other physical properties of the formation and fluids contained therein. Measurements of parameters of the geological formation are typically performed using many devices including downhole formation tester tools. In certain applications, the tools may be used for logging-while-drilling (LWD) or measurement-while drilling (MWD) purposes.

Recent formation tester tools generally have one or more probes for collecting samples of the formation fluids and may contain chambers for storage of the collected fluid samples. To collect samples, the probes form a sealing surface with a wellbore wall and pump formation fluids out of the formation for testing. To make an effective seal, the probes must penetrate through a drilling mud layer before reaching the wellbore wall. The drilling mud layer may compromise the seal between the probes and the wellbore wall and contaminate the sample with drilling mud. It is desirable to increase the efficacy of the formation tester tools by creating a stronger seal between the probes and the wellbore wall, thereby insuring a more accurate, less contaminated sample of formation fluids. Additionally, it is desirable to increase the efficacy of the formation tester tools by providing for repeated uses without extraction.

FIGURES

Some specific exemplary embodiments of the disclosure may be understood by referring, in part, to the following description and the accompanying drawings.

Figure 6A:
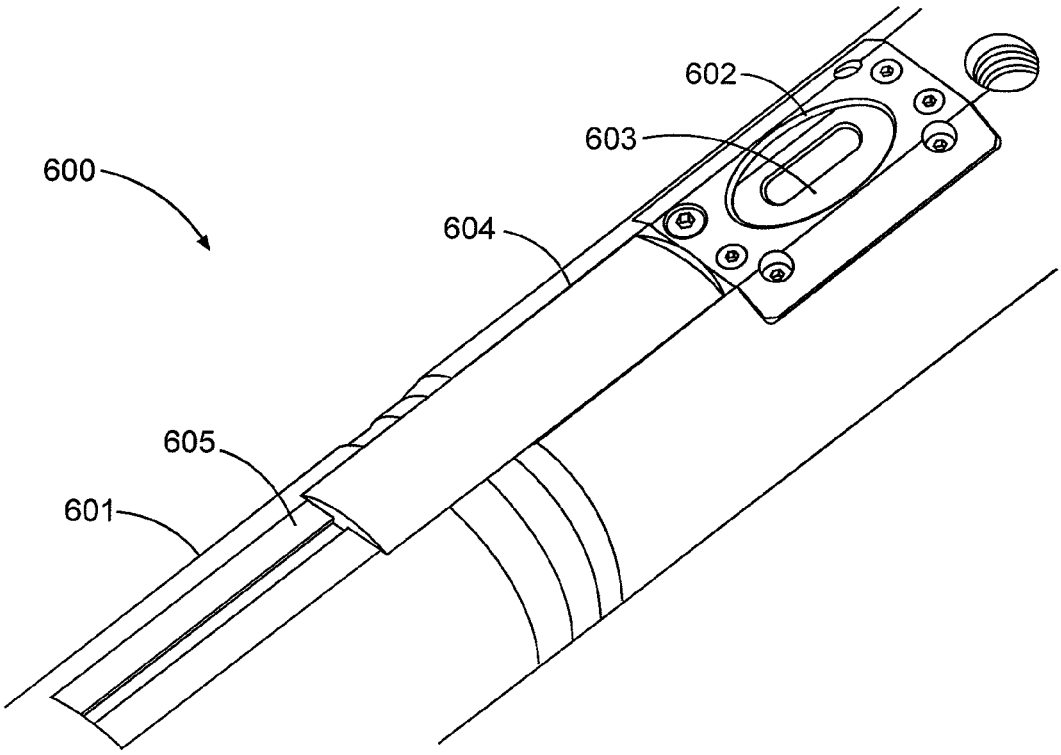
Figure 6B:
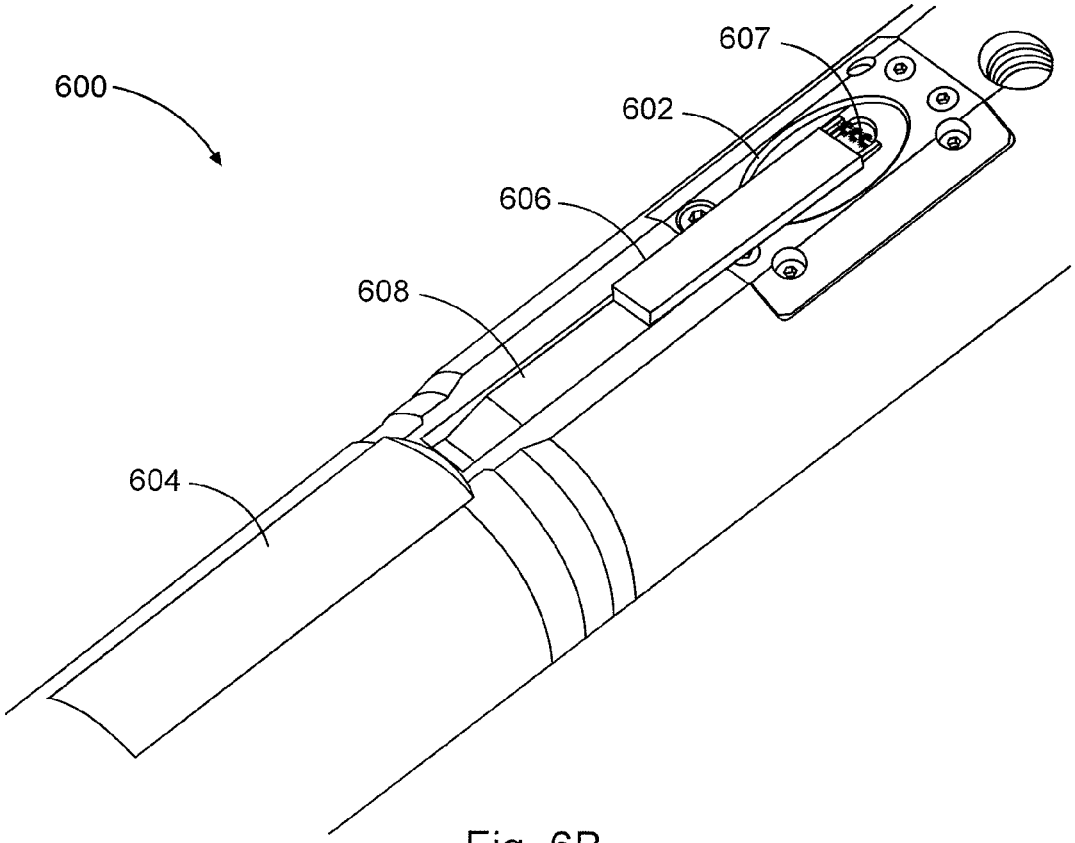
Figure 6C:
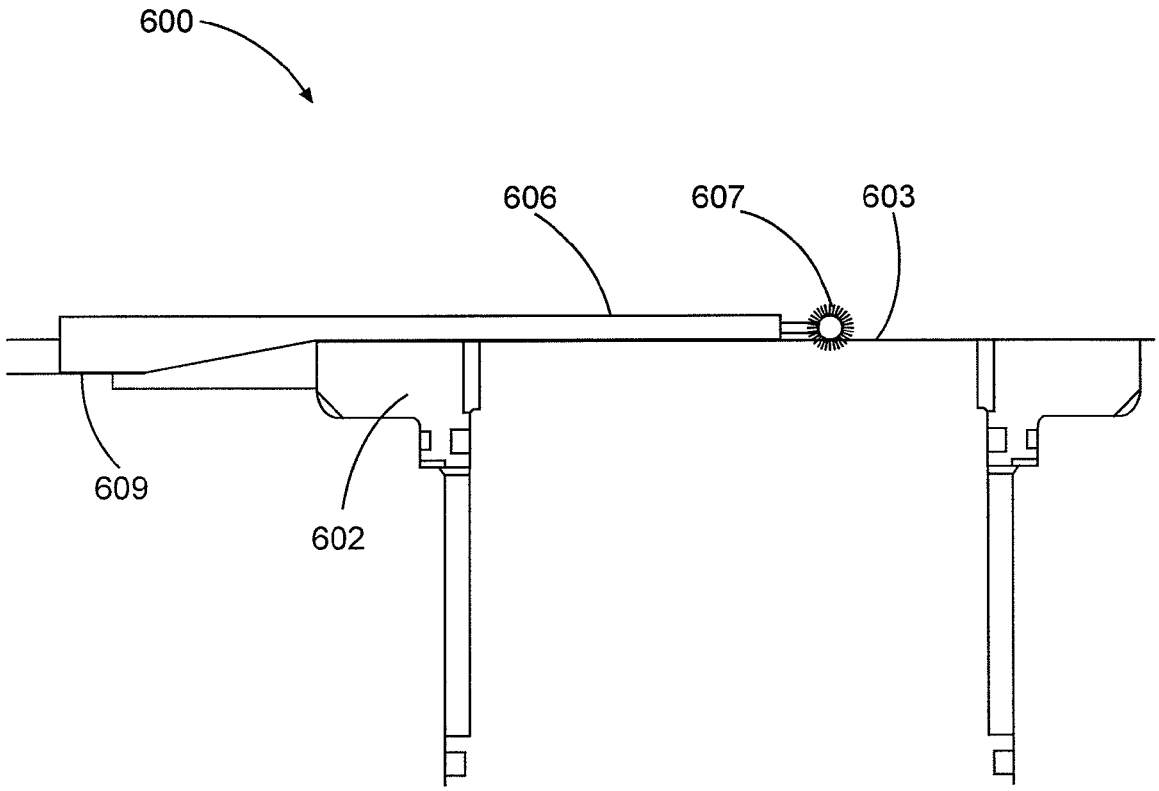

FIGS. 6A-C show an example formation tester tool with a retractable cleaning mechanism, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure generally relates to testing and evaluation of subterranean formations and formation fluids and, more particularly, to systems and methods for cleaning a well face during formation testing operations.

Illustrative embodiments of the present invention are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

To facilitate a better understanding of the present invention, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Devices and methods in accordance with certain embodiments may be used in one or more of wireline, measurement-while-drilling (MWD) and logging-while-drilling (LWD) operations. Embodiments may be implemented in various formation tester tools suitable for testing, retrieval and sampling along sections of the formation that, for example, may be conveyed through flow passage in tubular string or using a wireline, slickline, coiled tubing, downhole robot or the like.

Figure 1:
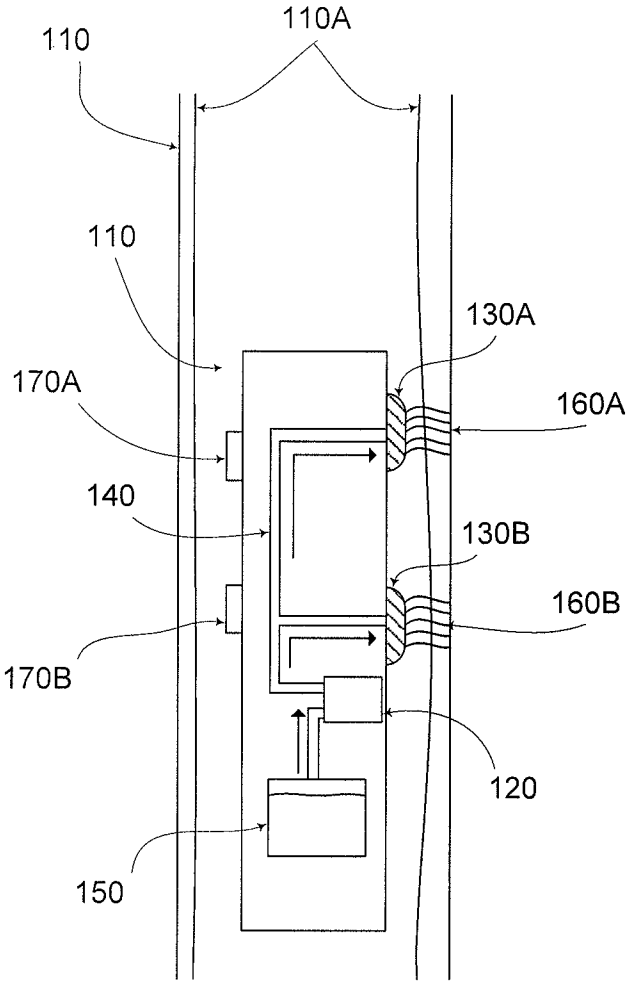
FIG. 1 is a cross-sectional schematic of an example formation tester tool in a wellbore according to aspects of the present disclosure.

FIG. 1 illustrates a cross-sectional schematic of an example formation tester tool 100, which may be disposed in a wellbore 110 traversing earth formations. The interior of the wellbore wall may be covered wholly or partially by a drilling mud layer 110*a*. The drilling mud layer may be left over from a drilling operation in which drilling mud is pumped into the wellbore from the surface to lubricate and cool the drill bit while the drill bit is penetrating the formation. The drilling mud layer 110*a* may have varying levels of viscosity depending on the types of fluid and solid matter composing the layer, including chemicals from the drilling mud itself, petrochemical fluids from the formation, and geologic fragments left over from the drilling process. As can be seen in FIG. 1, the drilling mud layer 110*a* may adhere, at least partially, to the wall of the wellbore 110.

The formation tester tool 100 may be suitable for testing, retrieval and sampling along sections of the formation via wellbore 110. A formation tester tool may be conveyed in a wellbore by wireline (not shown), which may contain conductors for carrying power to the various components of the tool and conductors or cables (coaxial or fiber optic cables)

for providing two-way data communication between tool 100 and an uphole control unit (not shown). The control unit preferably includes a computer and associated memory for storing programs and data. The control unit may generally control the operation of tool 100 and process data received from it during operations. The control unit may have a variety of associated peripherals, such as a recorder for recording data, a display for displaying desired information, printers and others. The use of the control unit, display and recorder are known in the art of well logging and are, thus, not discussed further.

As shown in FIG. 1, formation tester tool 100 may include a pump 120, which may be a double acting piston pump, for example. The pump 120 may control the fluid flow into and out of probes 130A and 130B via fluid flow line 140. The number of probes may vary depending on implementation.

The pump 120 may pump fluid out of or into collection chamber 150. The collection chamber 150 may be of various sizes, for example one gallon. The collection chamber 15 may be totally or partially filled at the surface with a cleansing fluid prior to the formation tester tool 100 being lowered into the wellbore 110. In some embodiments the cleansing fluid may be water. The water may be fresh water from the surface or recycled water from other drilling operations. In some embodiments, the cleansing fluid may be a mixture of water, or some other solvent, with surfactants and other chemicals. In yet other embodiment, the cleansing fluid may be superheated or super-cooled at the surface before being stored in the collection chamber 150.

When the formation tester tool 100 is lowered downhole, and the formation tester tool 100 is positioned at a first location within a wellbore, such as at a pre-determined depth or formation strata, a control unit at the surface may engage the formation tester tool 100. Engaging the formation tester tool 100 may cause the pump to energize, ejecting the cleansing fluid out of the collection chamber 150, through the fluid flow line 140, and out of the formation tester tool 100 via ports within probes 130A and 130B, as shown in FIG. 1. The ports, as will be discussed below, may comprise slits, which focus the cleansing fluid, causing pressurized streams 160A and 160B to be sprayed from the probes 130A and 130B. The combination of the pressure of streams 160A and 160B and the characteristics of the cleansing fluid may combine to remove most or all of the drilling mud layer 110*a* from the wellbore in the area immediately adjacent to the probes 130A and 130B.

Figure 2:
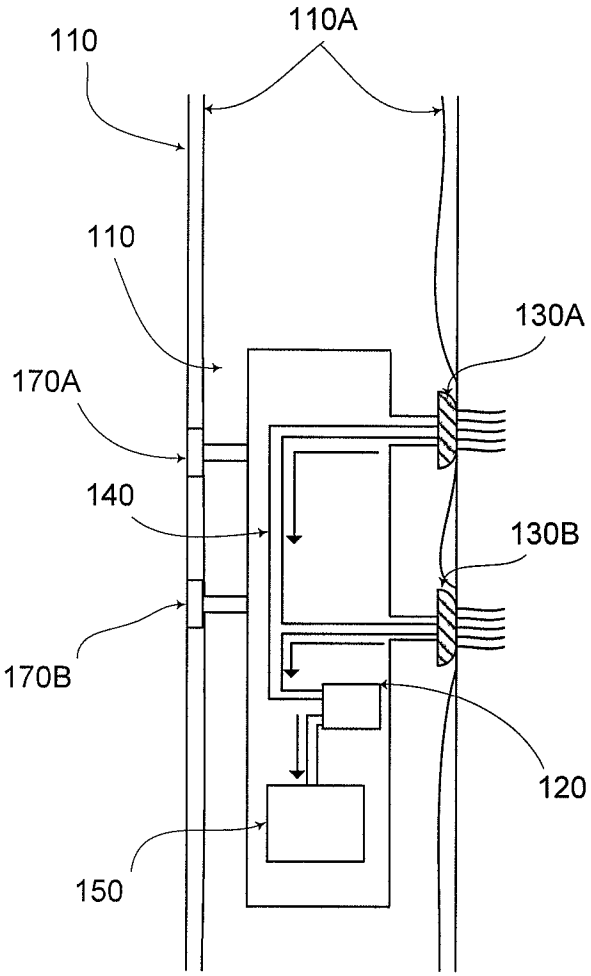
FIG. 2 is a cross-sectional schematic of an example formation tester tool in a wellbore according to aspects of the present disclosure.

During or after the cleansing fluid is sprayed out of probes 130A and 130B, the control unit may trigger setting rams 170A and 170B and probes 130A and 130B to extend outward from the formation tester tool 100, as shown in FIG. 2. The setting rams 170A and 170B are shown located generally opposite probes 130A and 130B of the tool, but may be located elsewhere as necessary to stabilize the formation tester tool 100. The setting rams 170A and 170B and probes 130A and 130B may continue extending until each contacts the wellbore wall. For example, a flat or substantially flat face of the probes 130A and 130B may contact the wellbore wall. As can be seen in FIG. 2, the contact location for probes 130A and 130B has been cleaned by the pumped cleansing fluid. By spraying the cleansing fluid out of the probes 130A and 130B, the probes are insured to contact a location that is relatively clean of drilling mud as compared to the surrounding wellbore wall.

Once the setting rams 170A and 170B and probes 130A and 130B contact the wellbore wall, the control unit may trigger the pump to begin drawing formation fluids into the formation tester tool 100, at least partially filling the collection chamber 150 with formation fluid. The pump 110 may cause formation fluids to be extracted from the formation and into the formation tester tool through the probes 130A and 130B via flow line 120. Because the wellbore wall has been cleansed of drilling mud, the probes 130A and 130B may contact the formation directly, without having to penetrate the drilling mud layer 110*a*. This leads to a more accurate sample of the formation fluids, without drilling mud contamination. Additionally, because the cleansing fluid in collection chamber 150 was used to cleanse the wellbore wall, the collection chamber 150 can be filled with a fresh sample of formation fluids via pump 120. Reusing collection chamber 150 increases the overall functionality of the formation tester tool 100 without requiring additional storage capacity.

As previously mentioned, the cleansing fluid may include some combination of a solvent, such as water, and a chemical, such as a surfactant. Additionally, the cleansing fluid may be heated or cooled. The characteristics of the cleansing fluid may be tailored to the particular composition of the drilling mud layer, as determined at least by the wellbore, drilling, and formation characteristics. For example, in some instances, a drilling mud with a particular density and viscosity may be used to adequately lubricate a drill bit for the drilling process. Petrochemicals and other fluids, as well as cuttings from the formation, may become displaced within the drilling mud layer on the wellbore wall. For particularly viscous drilling mud layers, some combination of chemicals and temperature variation in the cleansing fluid may be required to adequately cleanse the drilling mud from the wellbore wall. The drilling mud layer composition may be determined based on a variety of information, such as measurements, recorded at the surface. Based on the information, a well site operator may optimize the cleansing fluid according to the drilling mud layer characteristics.

Figure 3:
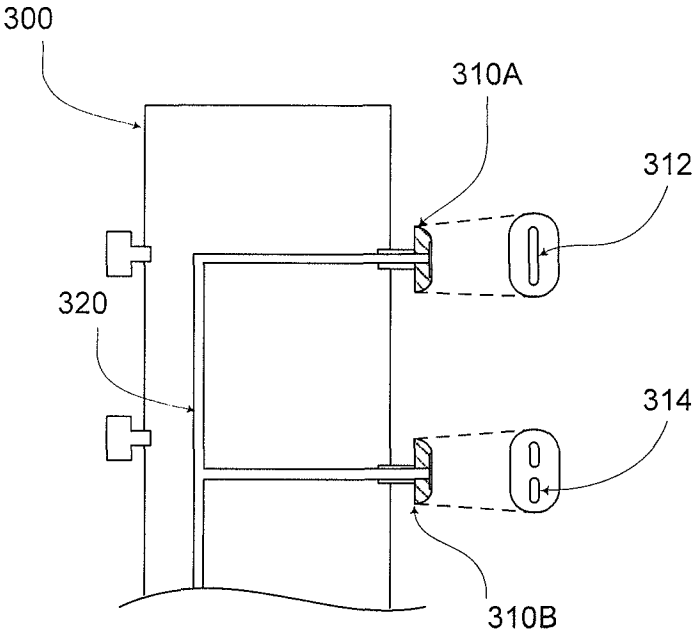
FIG. 3 is a partial diagram of a formation tester tool in a wellbore according to aspects of the present disclosure.

In addition to the cleansing fluid, the probes may be optimized to provide a pressurized stream of cleansing fluid. Two examples are shown in FIG. 3. As can be seen in FIG. 3, the formation tester tool 300 includes two probes 310A and 310B. Each of the probes 310A and 310B are connected to a collection container and pump (not shown) via fluid flow line 320. When pumped, cleansing fluid may stream out of the face of probes 310A and 310B at slits 312 and 314. As can be seen, the slits may have a variety of configurations. The size and shape of slits 312 and 314 may be configured according to the viscosity of the cleansing fluid and the formation fluids to be collected in the formation tester tool 300.

Figure 5A:
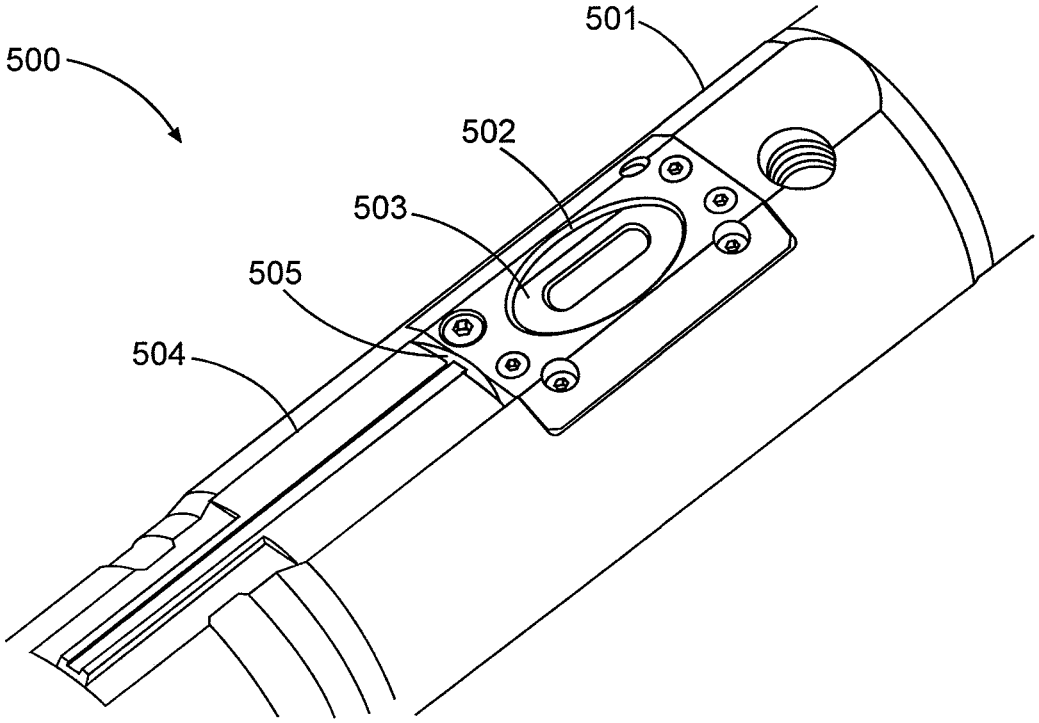
FIGS. 5A and 5B show an example formation tester tool with a retractable cleaning mechanism, according to aspects of the present disclosure.
Figure 5B:
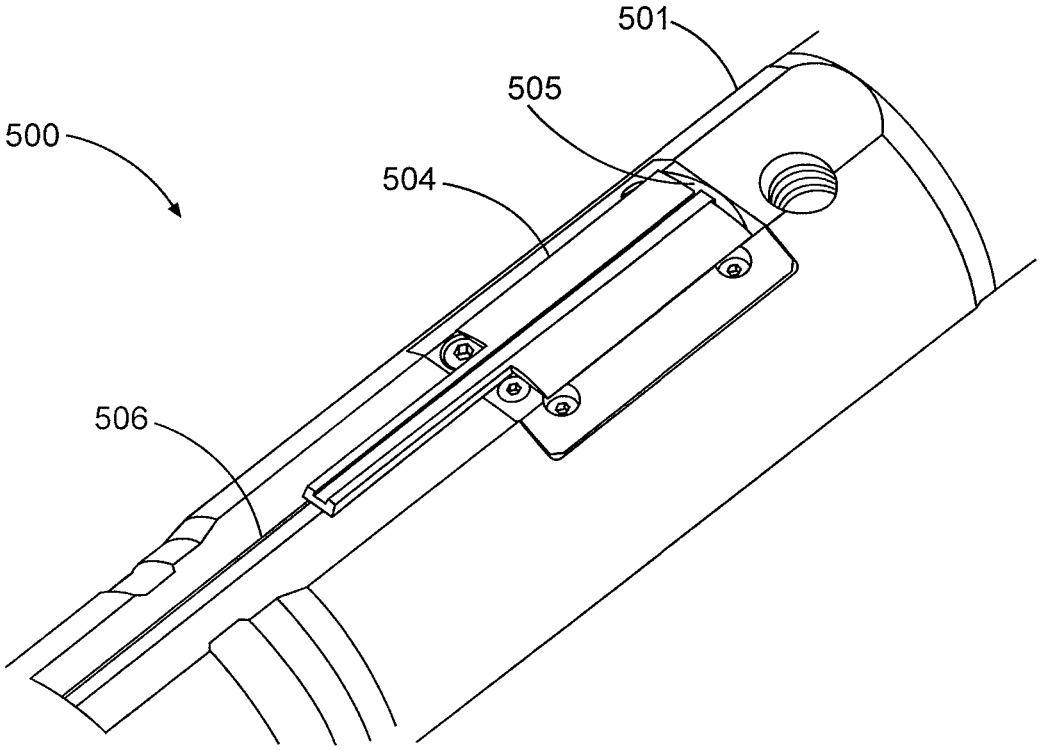

In some cases, the drilling mud may not be completely removed from the borehole wall before the probes are extended. In such cases, a layer of mud may form on the probe, limiting future operations. In certain embodiments, a formation tester tool incorporating aspects of the present disclosure may include a retractable cleaning mechanism that contacts a face of the probe and removes any mud buildup. FIGS. 5A-B illustrate an example formation tester tool 500 that incorporates a retractable cleaning mechanism, retractable blade 504. In the embodiment shown, the formation tester tool body 501 may be incorporated in a drill string for drilling operations. In FIG. 5A, the retracted probe 502 may have a face 503 substantially coplanar with an outer surface of the formation tester tool body 503. After the probe 502 has been deployed, and formation fluid has been sampled, the probe may be retracted into the position shown in FIGS. 5A and 5B. As can be seen in FIG. 5B, the retractable blade 504, with edge 505 may be extended toward the probe 502 along a track 506, and contact a face 503 of the probe 502. The retractable blade 504 may be powered, for example, using hydraulic power or another power source that would be appreciated by one of ordinary skill in view of this disclosure. The edge 505 may remove drilling mud build-up on the face of the probe 502 through a scraping action. The retractable blade 504 may then be retracted, leaving the probe 502 uncovered for future sampling operations.

FIGS. 6A-C illustrate an example formation tester tool 600 that incorporates another retractable cleaning mechanism embodiment, retractable brush mechanism 606. In the embodiment shown, the formation tester tool body 601 may be incorporated in a drill string for drilling operations. As can be seen in FIG. 6A, the formation tester tool 600 may include a cover plate 604 that protects the retractable brush mechanism 606 during drilling operations, for example. To expose the retractable brush mechanism 606, the cover plate may travel away from the probe 602 along track 605. When covered by the cover plate 604, the retractable brush mechanism 606 may fit into a slot 608 machined into the formation tester tool body 601. The retractable brush mechanism 606 may comprise a wedge shape 609 to accommodate the slot 608, and allow the cover plate 604 to slide freely over the retractable brush 606.

As can be seen, an end of the retractable brush mechanism 606 may include at least one brush 607. The brush 607 may contact a face 603 of the probe 602 when the retractable brush mechanism 606 is extended. The brush 607 may rotate around a cylindrical mount as the retractable brush mechanism 606 is extended, removing drilling mud build-up from the face 603 as the brush 607 rotates. In certain embodiments, the cover plate 604 and the retractable brush mechanism 606 may be powered, for example, using hydraulic power or another power source that would be appreciated by one of ordinary skill in view of this disclosure. Other brush configurations are possible, including fixed brushes of different shapes and sizes. The retractable cleaning mechanisms are not limited to the embodiments shown herein, and may take a variety of shapes and sizes, depending on the application.

In certain embodiments, the formation tester tool may include multiple retractable cleaning mechanisms. One retractable cleaning mechanism may contact a face of the probe, as described above. Another retractable cleaning mechanism may contact a formation at a position adjacent to the probe. To use the multiple retractable cleaning mechanisms, setting rams, such as setting rams 170A and 170B, may be extended, urging the side of the formation tester tool with the probes towards the borehole wall. A first retractable cleaning mechanism may then be extended, contacting the face of the borehole wall, and wiping some or all of the drilling mud away from the borehole wall. In certain embodiments, the first retractable cleaning mechanism may comprise a similar structure to the retractable cleaning mechanism 606, but may be disposed on an opposite side of the probe from the retractable cleaning mechanism 606. The first retractable cleaning mechanism may include a brush, for example, similar to the brush on retractable cleaning mechanism 606.

In certain embodiments, cleansing fluid may be ejected from the probe at the same time the first retractable cleaning mechanism is contacting the borehole wall. Once the first retractable cleaning mechanism has made a predetermined number of passes against the borehole wall, it may be retracted, and the probe may be extended to form a seal with the borehole wall. Once a formation fluid sample has been taken, the probe may be retracted, and a second retractable cleaning mechanism, similar to retractable cleaning mechanism 606, may contact a face of the probe, removing any drilling mud that has become caked on the probe.

Figure 4:
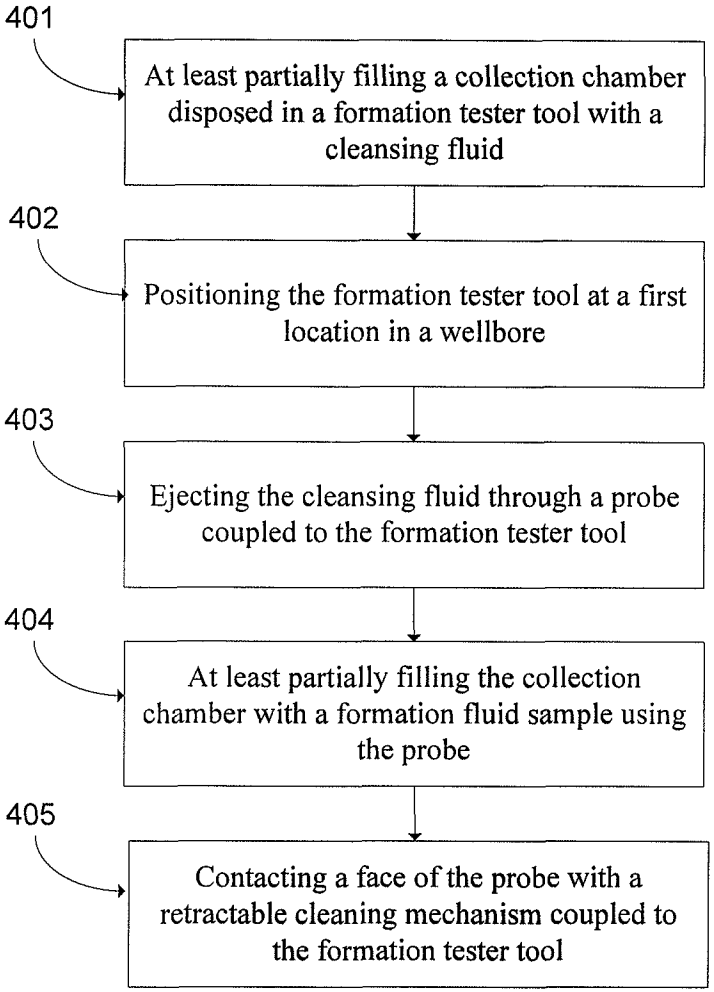
FIG. 4 is an example method for cleaning a well face during formation tester operations, incorporating aspects of the present disclosure.

FIG. 4 illustrates an example method incorporating aspects of the present invention. At step 401, the method may include at least partially filling a collection chamber in a formation tester tool with a cleansing fluid. As mentioned previously, the cleansing fluid may include a solvent and a chemical, such as a surfactant, and may be temperature-controlled, such as super-heated or super-cooled. The cleansing fluid may be mixed at the drilling site or remotely at another location. In some embodiments, the cleansing fluid may be shipped to the drilling site in a container, where it is pumped into a collection chamber in a formation tester tool, such as chamber 150 in formation tester tool 100 from FIG. 1.

At step 402, the method may include positioning the formation tester tool at a first location in a wellbore. The formation tester tool may be lowered until a certain depth, matching particular formation strata, is reached. The particular depth may be determined by seismographic and other measurements of the formation. In certain embodiments, the formation tester tool may be lowered downhole as a part of other equipment, such as a drill string.

Step 403 may include ejecting the cleansing fluid through a probe coupled to the formation tester tool. The first location may be predetermined according to the description above. Ejecting the cleansing fluid may include, but does not require, a control unit at the surface triggering a pump in the formation tester tool to spray the cleansing fluid from a collection container of the formation tester tool through probes of the formation tester tool at a drilling mud layer of the wellbore. Step 403 may occur before or during the extension of probes and setting rams of the formation tester tool outward to contact the wellbore wall.

Step 404 may comprise at least partially filling the collection chamber with a formation fluid sample using the probe. The fluid may be pumped through a probe of the formation tester tool and stored in the collection chamber via a fluid flow line. In certain embodiments, the collected sample may be used to clean the drilling mud from a second location within the wellbore.

Step 405 may comprise contacting a face of the probe with a retractable cleaning mechanism coupled to the formation tester tool. As described above, the probe may accumulate a drilling mud build-up as the probe is extended to take a formation sample. The retractable cleaning mechanism may remove most or all of the drilling-mud build up and allow the probe to be used again.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. A method of collecting formation fluids for testing, the method comprising:

introducing a formation tester tool into a wellbore, wherein the formation tester tool comprises a tool body;

a probe extendable from the tool body; and a first retractable cleaning mechanism coupled to the tool body;

ejecting a fluid through the probe;

positioning the probe against a surface of the wellbore at a first location;

pumping fluid from a formation; and contacting a face of the probe with the first retractable cleaning mechanism when the probe is in a retracted position with respect to the tool body.

2. The method of claim 1, further comprising filling a collection chamber within the formation tester tool with a cleansing fluid.

3. The method of claim 1, wherein the cleansing fluid comprises a super-heated fluid.

4. The method of claim 2, wherein the cleansing fluid comprises a super-cooled fluid.

5. The method of claim 2, wherein the cleansing fluid comprises a chemical additive.

6. The method of claim 1, wherein the first retractable cleaning mechanism comprises a retractable blade.

7. The method of claim 1, wherein the first retractable cleaning mechanism comprises a retractable brush.

8. A method of cleaning a well face during formation testing, the method comprising:

at least partially filling a collection chamber with a cleansing fluid, wherein the filling chamber is disposed within a tool body of a formation tool;

positioning the formation tester tool at a first location in a wellbore;

ejecting the cleansing fluid through a probe extendable from the tool body;

at least partially filling the collection chamber with a formation fluid sample using the probe; and contacting a face of the probe with a first retractable cleaning mechanism coupled to the tool body when the probe is in a retracted position with respect to the tool body.

9. The method of claim 8, wherein the cleansing fluid is super-heated water.

10. The method of claim 8, wherein the cleansing fluid is super-cooled water.

11. The method of claim 8, wherein the cleansing fluid includes a surfactant.

12. The method of claim 8, wherein the first retractable cleaning mechanism comprises a retractable blade.

13. The method of claim 8, wherein the first retractable cleaning mechanism comprises a retractable brush.

14. A formation tester tool for cleaning a well face during formation testing, comprising:

a tool body;

a collection chamber disposed within the tool body, wherein the collection chamber is at least partially filled with a cleansing fluid;

a probe extendable from the tool body, wherein the probe is in fluid communication with the collection chamber via a fluid flow line; and a pump in fluid communication with the probe;

a first retractable cleaning mechanism coupled to the tool body, wherein the first retractable cleaning mechanism is positioned to contact a face of the probe when the retractable cleaning apparatus is extended and the probe is in a retracted position with respect to the tool body.

15. The formation tester tool of claim 14, wherein the cleansing fluid comprises at least one of super-heated water and super-cooled water.

16. The formation tester tool of claim 15, wherein the first retractable cleaning mechanism comprises a retractable blade.

17. The formation tester tool of claim 15, wherein the first retractable cleaning mechanism comprises a retractable brush.

* * * * *